US010085567B1

(12) United States Patent
Reyes et al.

(10) Patent No.: US 10,085,567 B1
(45) Date of Patent: Oct. 2, 2018

(54) WALL-MOUNTED FOLD-AWAY COUCH AND BED

(71) Applicants: Elvis Reyes, Perth Amboy, NJ (US); Juan Reyes, Perth Amboy, NJ (US)

(72) Inventors: Elvis Reyes, Perth Amboy, NJ (US); Juan Reyes, Perth Amboy, NJ (US)

( * ) Notice: Subject to any disclaimer, the term of this patent is extended or adjusted under 35 U.S.C. 154(b) by 87 days.

(21) Appl. No.: 15/351,485

(22) Filed: Nov. 15, 2016

(51) Int. Cl.
*A47C 17/26* (2006.01)
*A47C 17/213* (2006.01)
*A47C 17/165* (2006.01)
*A47C 17/38* (2006.01)

(52) U.S. Cl.
CPC ..... *A47C 17/213* (2013.01); *A47C 17/165* (2013.01); *A47C 17/38* (2013.01)

(58) Field of Classification Search
CPC ..... A47C 17/26
USPC ..... 5/2.1, 1, 6
See application file for complete search history.

(56) References Cited

U.S. PATENT DOCUMENTS 2,534,300 A 2/1977 Doering
D272,968 S 3/1984 Fairaizen
5,136,737 A 8/1992 Reppas
5,652,978 A 8/1997 Wiig
6,779,208 B2 8/2004 Lim
7,802,329 B1 9/2010 Shrock
2006/0150326 A1* 7/2006 Miller ..... A47C 17/40 5/136

FOREIGN PATENT DOCUMENTS

EP 2363044 A1 9/2011

* cited by examiner

*Primary Examiner* — Frederick C Conley
(74) *Attorney, Agent, or Firm* — Kyle A. Fletcher, Esq.

(57) ABSTRACT

The wall mounted fold away couch and bed is wall treatment that comprises a combination wall bed and couch. The wall mounted fold away couch and bed is a wall frame that further contains a bed frame and a seat frame. The bed frame is attached to the wall frame such that the bed frame can be rotated out of the wall frame to allow the use of the bed frame as a bed. The seat frame is attached to the bed frame such that the seat frame is accessible while the bed frame is stored within the wall frame. The seat frame is attached to the bed frame such that the seat frame rotates off of the bed frame allowing seat frame can be used as a chair. The wall mounted fold away couch and bed comprises a wall frame, a bed frame, and a seat frame.

19 Claims, 6 Drawing Sheets

WALL-MOUNTED FOLD-AWAY COUCH AND BED

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including sofas, couches and beds, more specifically, a combination of a wall treatment and a seating device with movable parts that are changeable into a bed.

SUMMARY OF INVENTION

The wall mounted fold away couch and bed is wall treatment that comprises a combination wall bed and couch. The wall mounted fold away couch and bed is a wall frame that contains a bed frame and a seat frame. The bed frame is attached to the wall frame such that the bed frame can be: 1) contained within the wall frame for storage; or, 2) rotated out of the wall frame such that the bed frame can be used as a bed. The seat frame is attached to the bed frame such that the seat frame is accessible while the bed frame is stored within the wall frame. The seat frame is attached to the bed frame such that the seat frame can be: 1) stored on the bed frame for storage; or, 2) rotated off of the bed frame such that the seat frame can be used as a chair.

These together with additional objects, features and advantages of the wall mounted fold away couch and bed will be readily apparent to those of ordinary skill in the art upon reading the following detailed description of the presently preferred, but nonetheless illustrative, embodiments when taken in conjunction with the accompanying drawings.

In this respect, before explaining the current embodiments of the wall mounted fold away couch and bed in detail, it is to be understood that the wall mounted fold away couch and bed is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall mounted fold away couch and bed.

It is therefore important that the claims be regarded as including such equivalent construction insofar as they do not depart from the spirit and scope of the wall mounted fold away and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
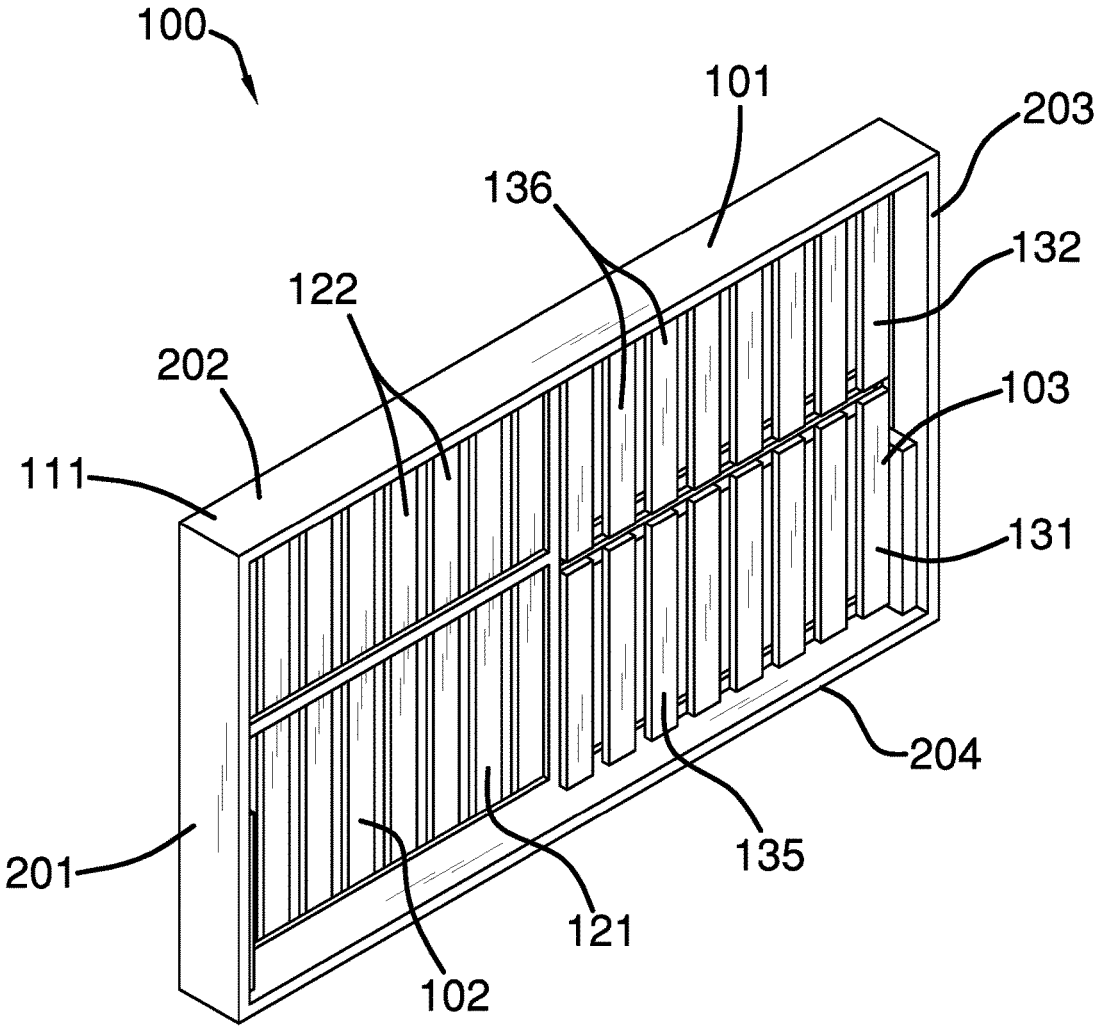
FIG. 1 is a closed perspective view of an embodiment of the disclosure.
Figure 2:
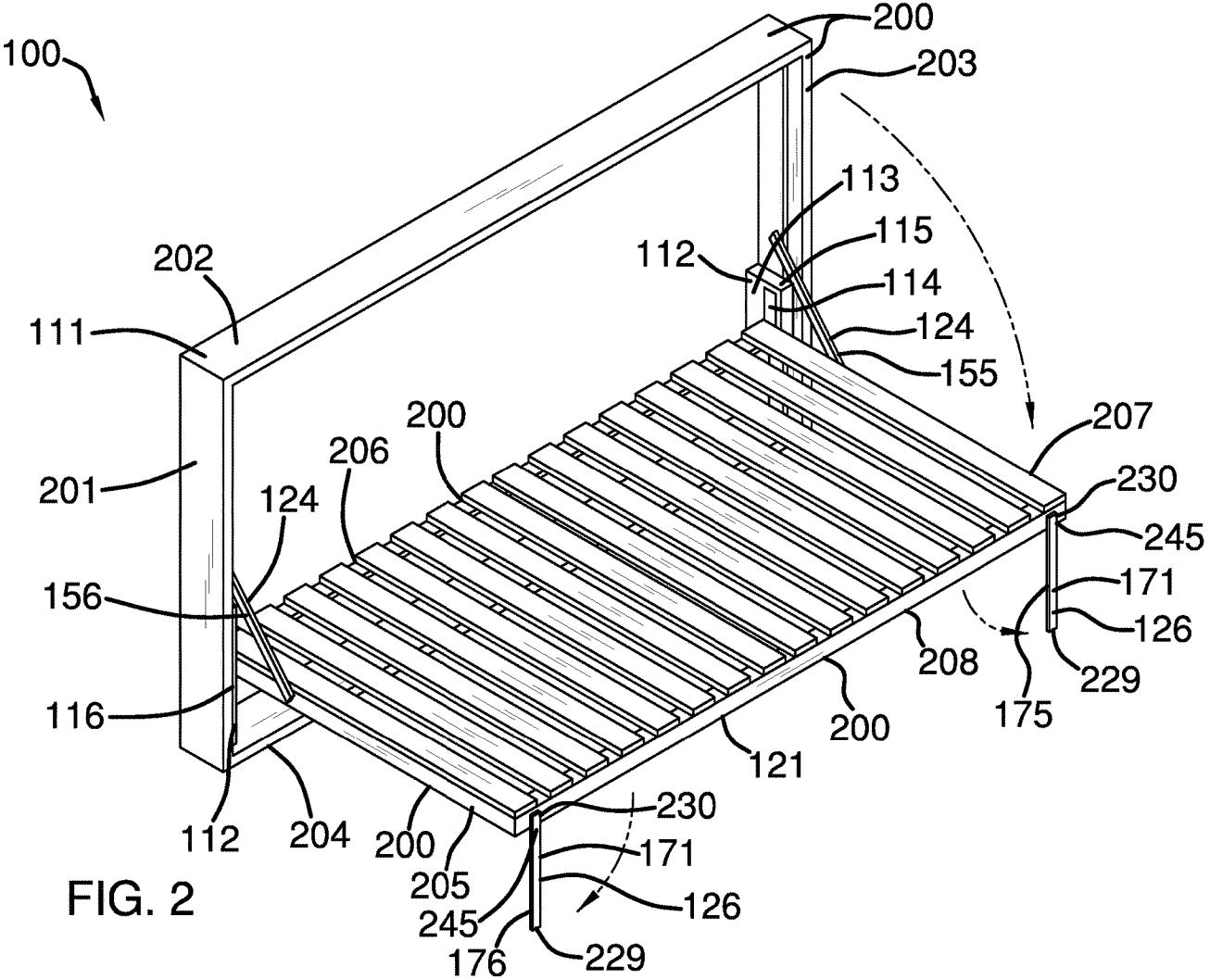
FIG. 2 is an open perspective view of a first operating configuration of an embodiment of the disclosure.
Figure 3:
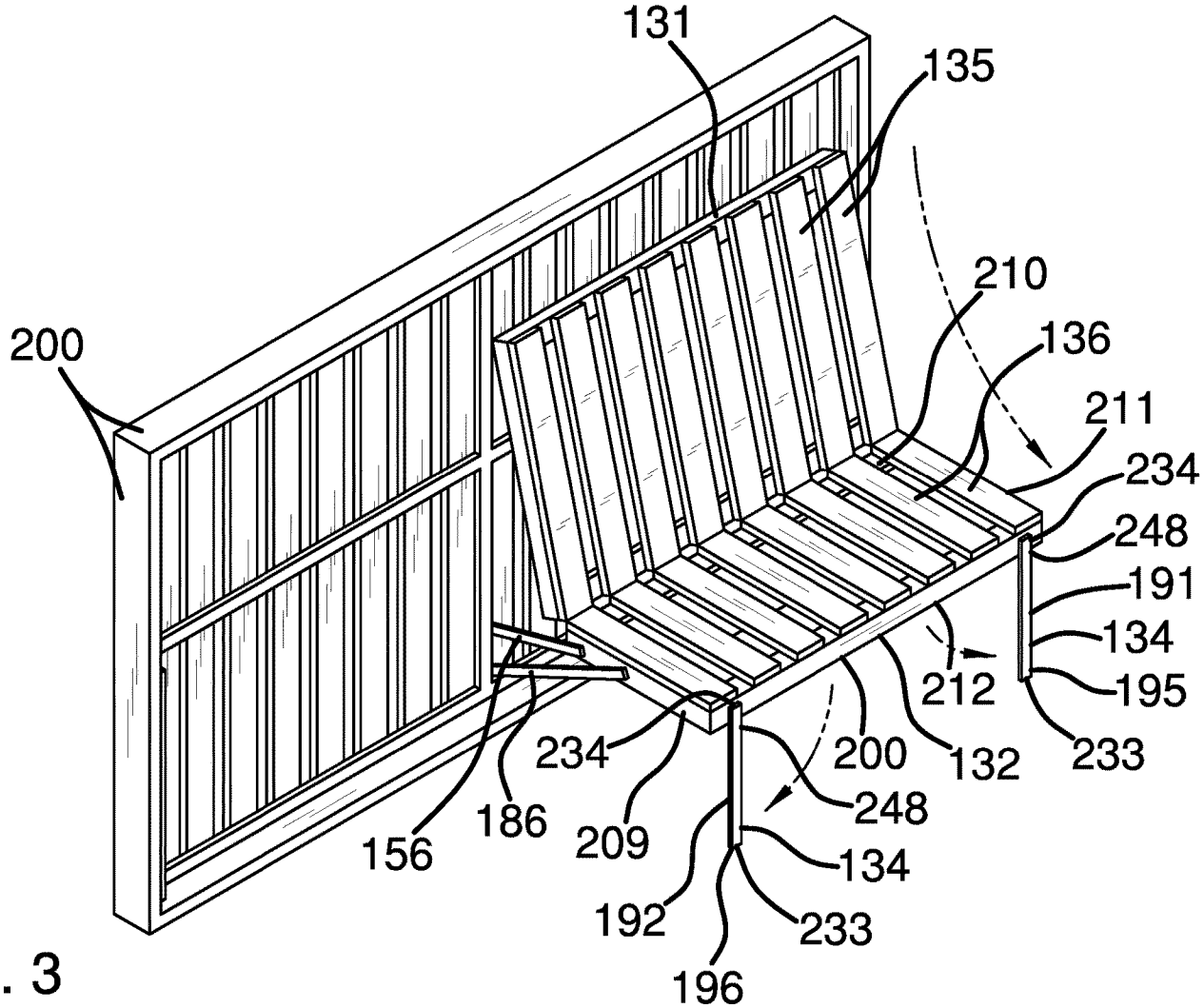
FIG. 3 is an open perspective view of a second operating configuration of an embodiment of the disclosure.
Figure 4:
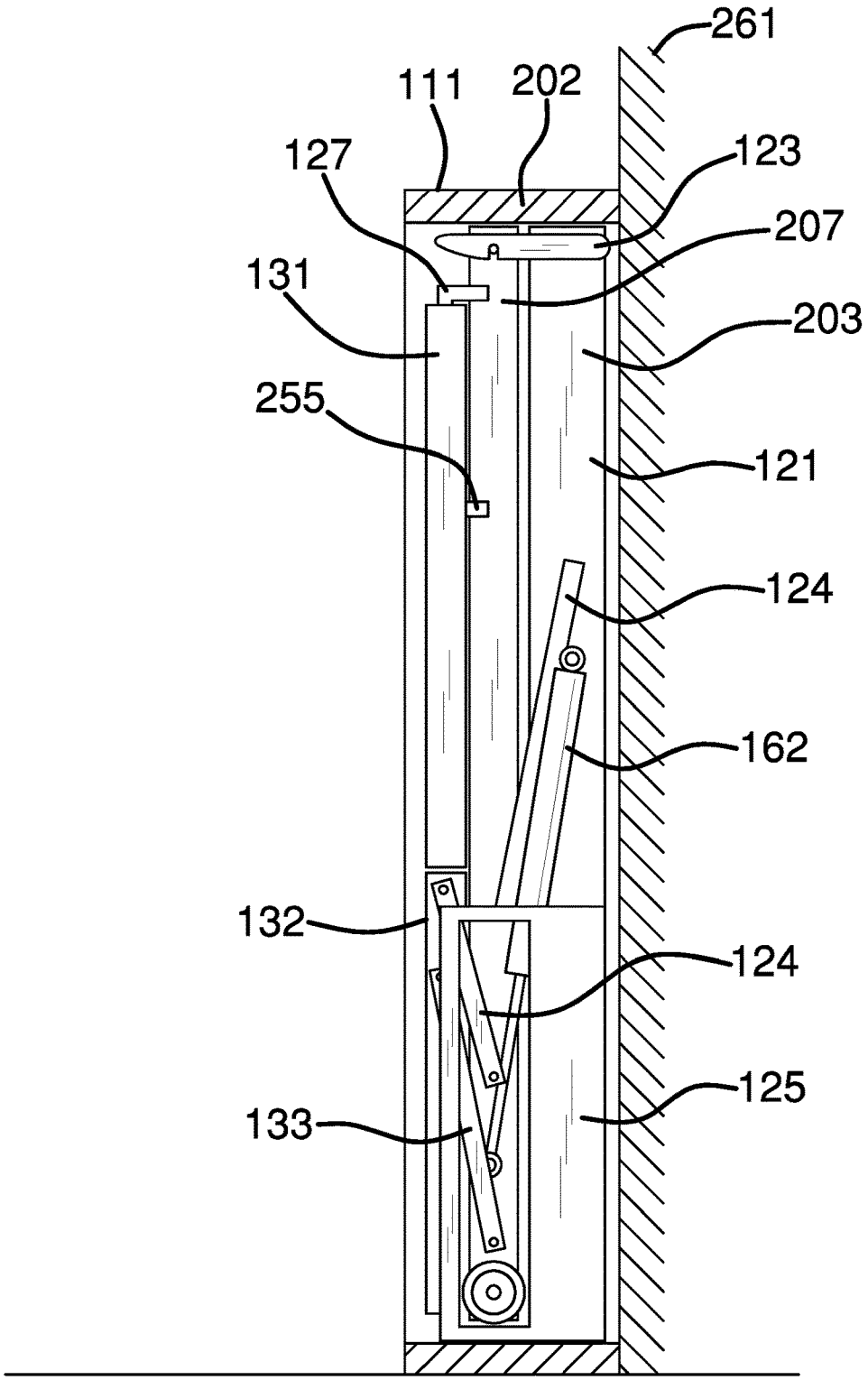
FIG. 4 is a closed side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The wall mounted fold away couch and bed comprises 100 (hereinafter invention) a wall frame 101, a bed frame 102, and a seat frame 103. The invention 100 is wall 261 treatment that comprises a combination wall bed and couch. The invention 100 is a wall frame 101 that contains a bed frame 102 and a seat such that the bed frame 102 can be: 1) contained within the wall frame 101 for storage; or, 2) rotated out of the wall frame 101 such that the bed frame 102 can be used as a bed. The seat frame 103 is attached to the bed frame 102 such that the seat frame 103 is accessible while the bed frame 102 is stored within the wall frame 101. The seat frame 103 is attached to the bed frame 102 such that the seat frame 103 can be: 1) stored on the bed frame 102 for storage; or, 2) rotated off of the bed frame 102 such that the seat frame 103 can be used as a chair.

Throughout this disclosure, reference will be made to individual struts selected from a plurality of struts 200. Each strut selected from the plurality of struts 200 is a beam or other structural member that is used to resist deformation of the invention 100 under load. The a plurality of struts 200 comprises a first strut 201, a second strut 202, a third strut 203, a fourth strut 204, a fifth strut 205, a sixth strut 206, a seventh strut 207, an eighth strut 208, a ninth strut 209, a tenth strut 210, an eleventh strut 211, a twelfth strut 212.

Each of the plurality of struts 200 will be called out separately and further described as they are discussed within the disclosure.

Throughout this disclosure, reference will be made to individual pivots selected from a plurality of pivots 240. Each commercially available hinge or pivot that is used to join a first element and a second element such that the first element can rotate relative to the second element. The plurality of pivots 240 comprises a first pivot 241, a second pivot 242, a third pivot 243, a fourth pivot 244, a fifth pivot 245, a sixth pivot 246, a seventh pivot 247, and an eighth pivot 248. Each of the plurality of struts 200 will be called out separately and further described as they are discussed within the disclosure.

The wall frame 101 is mounted on a wall 261. The wall frame 101 further comprises a first rectangular structure 111 and a plurality of rails 112. The first rectangular structure 111 is a rectangular frame that further comprises the first strut 201, the second strut 202, the third strut 203, and the fourth strut 204. Each of the plurality of rails 112 further comprises a plank 113 and a track 114. Each of the plurality of rails 112 is a wooden plank 113 that is mounted on a strut selected from the first strut 201 or the third strut 203. As shown most clearly in FIG. 5, the plank 113 is a rectangular plate. The track 114 is a rectangular aperture that is formed through the plank 113.

In the first potential embodiment of the disclosure, the plurality of rails 112 further comprises a left rail 115 and a strut 201 and the left rail 115 is mounted on the third strut 203.

The bed frame 102 is mounted within the wall frame 101. The bed frame 102 comprises a second rectangular structure 121, a plurality of bed slats 122, a plurality of locking arms 123, a plurality of sustaining arms 124, a plurality of carriages 125, a plurality of bed legs 126, and a plurality of seat supports 127. The second rectangular structure 121 is a rectangular frame that is intended to receive a mattress. The second rectangular structure 121 further comprises the fifth strut 205, the sixth strut 206, the seventh strut 207, and the eighth strut 208. As shown most clearly in FIG. 2, the plurality of bed slats 122 are a collection of boards that form the surface upon which a mattress would rest. The ends of each of the plurality of bed slats 122 is attached to the sixth strut 206 and the eighth strut 208 such that any first bed slat selected from the plurality of bed slats 122 is parallel to any second bed slat selected from the plurality of bed slats 122.

Each of the plurality of locking arms 123 comprises locking bracket 141, a locking bolt 142, a notch 143 and the first pivot 241. The locking bracket 141 is a shaft like structure that is formed with a notch 143 in it. The locking bracket 141 is further defined with a first end 221 and a second end 222. The locking bracket 141 is a shaft like structure that that has the notch 143 formed in it. The notch 143 is sized such that the notch 143 will fit around the locking bolt 142. The locking bolt 142 is mounted to a first selected strut selected form the group consisting of the fifth strut 205 and the seventh strut 207. The locking bolt 142 is mounted such that the locking bolt 142 projects perpendicularly away from the selected strut. The second end 222 of the locking bracket 141 is mounted to the first strut 201 if the fifth strut 205 was selected or third strut 203 if the seventh strut 207 was selected. The locking bracket 141 is mounted using the first pivot 241.

In the first potential embodiment of the disclosure, the plurality of locking arms 123 further comprises a left locking arm 145 and a right locking arm 146. The left locking arm 145 mounts to the third strut 203 and the seventh strut 207. The right locking arm 146 mounts to the first strut 201 and the fifth strut 205.

Each of the plurality of sustaining arms 124 comprises a first arm 151, a second arm 152, a locking mechanism 153, the second pivot 242, the third pivot 243, and the fourth pivot 244. The first arm 151 is a shaft that is further defined with a third end 223 and a fourth end 224. The second arm 152 is a shaft that is further defined with a fifth end 225 and a sixth end 226. As shown most clearly in FIG. 6, the third end 223 are connected with the third pivot 243. The fifth end 225 of the second arm 152 attaches to a strut selected from the group consisting of the fifth strut 205 or the seventh strut 207 using the second pivot 242. The fourth end 224 of the first arm 151 attaches to a strut selected from the group consisting of the first strut 201 or the third strut 203. The third pivot 243 is a commercially available pivot or hinge that further comprises a locking mechanism 153 that is used to prevent each of the sustaining arms from collapsing under a load. Suitable locking mechanisms 153 include, but are not limited to, a cotter pin.

In the first potential embodiment of the disclosure, the plurality of sustaining arms 124 further comprises a left sustaining arm 155 and a right sustaining arm 156. The left sustaining arm 155 is attached to the third strut 203 and the seventh strut 207. The right sustaining arm 156 is attached to the first strut 201 and the fifth strut 205.

Each of the plurality of carriages 125 further comprises a hydraulic arm 162 and a wheel 163. The hydraulic arm 162 is further defined with a seventh end 227 and an eighth end 228. As shown most clearly in FIG. 6, the seventh end 227 of the hydraulic arm 162 attaches to a strut selected from the group consisting of the first strut 201 or the third strut 203. The selected from the group consisting of the first strut 201 or the third strut 203.

The wheel 163 attaches to a strut selected from the group consisting of the fifth strut 205 or the seventh strut 207. The wheel 163 attaches in such a manner that the wheel 163 rotates freely around its axis. The wheel 163 is mounted such that the wheel 163 fits with the track 114 of a rail selected from the plurality of rails 112. As the bed frame 102 is deployed out of or retracted into the wall frame 101, the track 114 guides the wheel 163 which in turn maintains the bed frame 102 in a proper path.

In the first potential embodiment of the disclosure, the plurality of carriages 125 further comprises a left carriage 165 and a right carriage 166. The left carriage 165 mounts to the third strut 203 and the seventh strut 207. The right carriage 166 mounts to the first strut 201 and the fifth strut 205.

Each of the plurality of bed legs 126 comprises a first leg 171. The first leg 171 is a shaft that is further defined with a ninth end 229 and a tenth end 230. As shown most clearly in FIG. 2, tenth end 230 of the first leg 171 attaches to the eighth strut 208 using the fifth pivot 245 in such a manner that the first leg 171 can rotate around the fifth pivot 245. In the first potential embodiment of the disclosure, the plurality of bed legs 126 further comprises a left bed leg 175 and a right bed leg 176.

Figure 5:
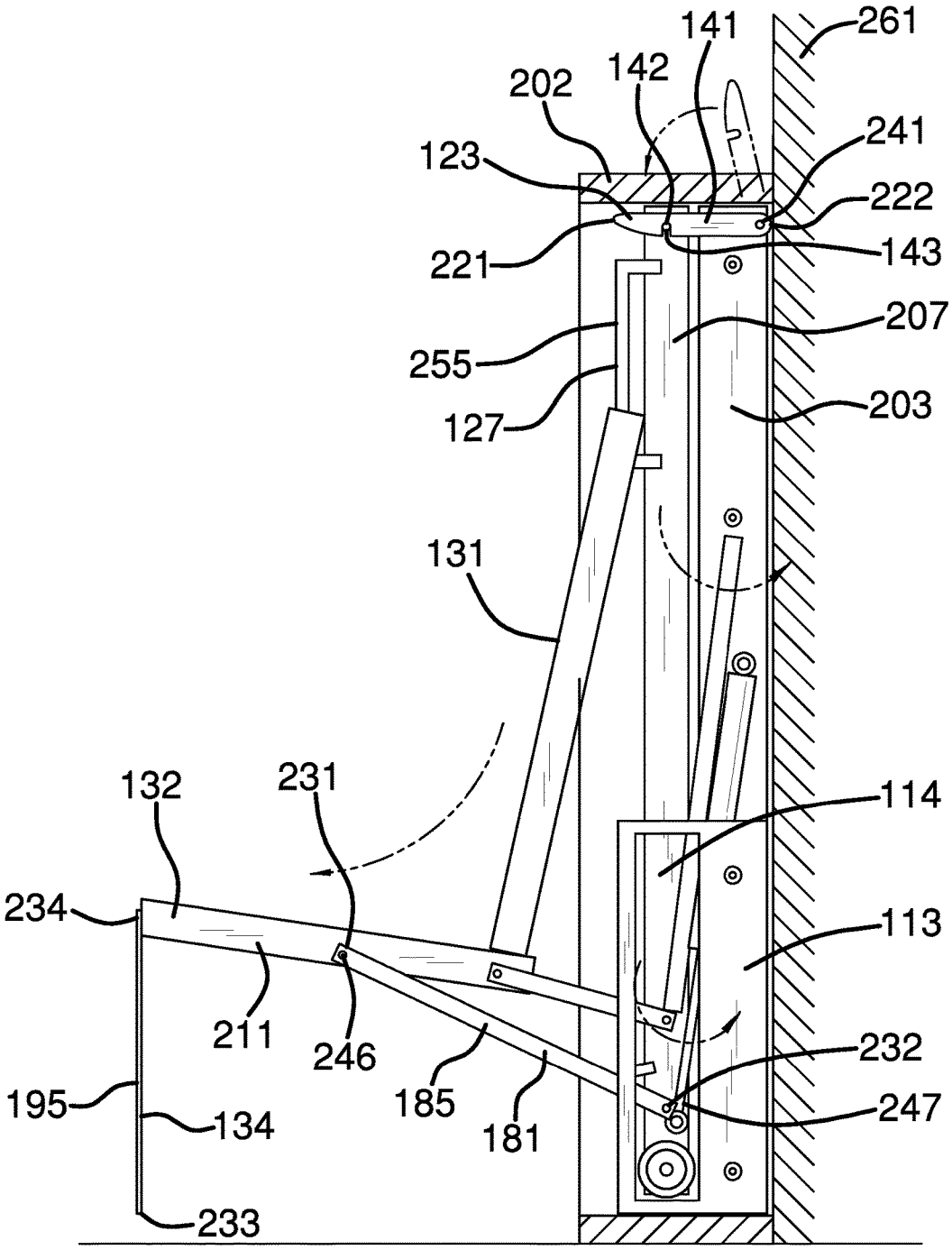
FIG. 5 is an open side view of a first operating configuration of an embodiment of the disclosure.
Figure 6:
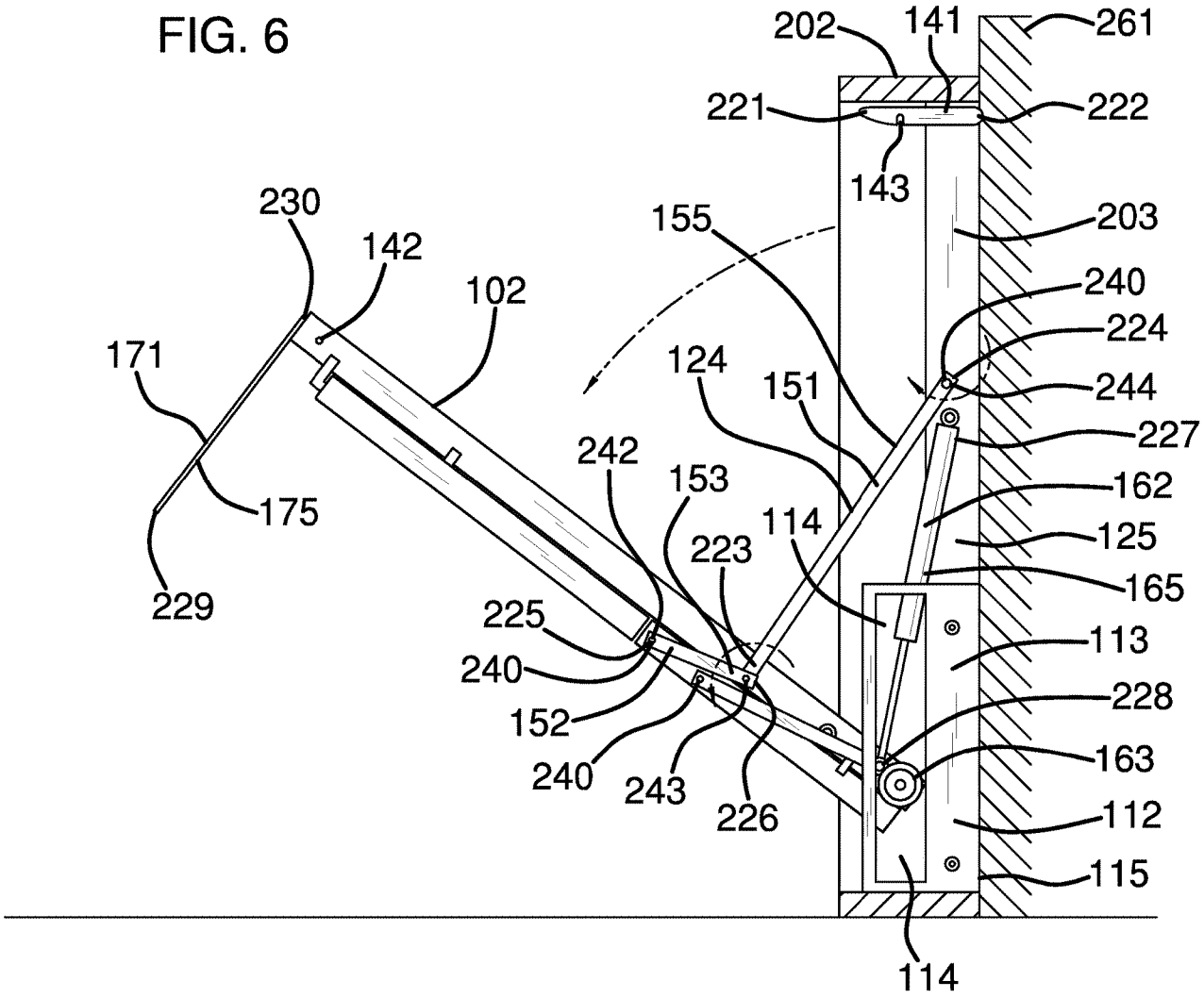
FIG. 6 is an open side view of a second operating configuration of an embodiment of the disclosure.

As shown most clearly in FIG. 5, each of the plurality of seat supports 127 is a U shaped bar that attaches to a strut selected from the from the group consisting of the fifth strut 205 or the seventh strut 207. As shown most clearly in FIGS. 4 and 5, each of the plurality of seat supports 127 is a guide around which the third rectangular structure 131 is hooked such that: 1) the third rectangular structure 131 can slide along each of the plurality of seat supports 127 as the seat frame 103 is deployed or retracted; and, 2) the third rectangular structure 131 is prevented from falling out of the wall frame 101. In the first potential embodiment of the disclosure, the plurality of seat supports 127 further comprises a left seat support 255 and a right seat support 256. The left seat support 255 mounts to the seventh strut 207. The right seat support 256 mounts to the fifth strut 205.

The seat frame 103 further comprises a third rectangular structure 131, a fourth rectangular structure 132, a plurality of sofa supports 133, and a plurality of sofa legs 134. The third rectangular structure 131 is a rectangular frame that further comprises first plurality of seat slats 135. The first plurality of seat slats 135 provides the surface that supports the back of a person seated on the seat frame 103. The fourth rectangular structure 132 is a rectangular frame that further comprises a second plurality of seat slats 136, the ninth strut 209, the tenth strut 210, the eleventh strut 211 and the twelfth strut 212. The second plurality of seat slats 136 supports 132 cushions upon which a person will sit. The ends of the second plurality of seat slats 136 are attached to the tenth strut 210 and the twelfth strut 212.

The plurality of sofa supports 133 further comprises a third arm 181, a sixth pivot 246 and a seventh pivot 247. The third arm 181 is a shaft that is further defined with an eleventh end 231 and a twelfth end 232. As shown most clearly in FIG. 5, the eleventh end 231 of the third arm 181 attaches to a strut selected from the group consisting of the ninth strut 209 or the eleventh strut 211 using the sixth pivot 246. The twelfth end 232 of the third arm 181 attaches to a strut selected from the group consisting of the fifth strut 205 or the seventh strut 207 using the seventh pivot 247.

In the first potential embodiment of the disclosure, the plurality of sofa supports 133 further comprises a left sofa support 185 and a right sofa support 186. The left sofa support 185 mounts to the seventh strut 207 and the eleventh strut 211. The right sofa support 186 mounts to the fifth strut 205 and the ninth strut 209.

Each of the plurality of sofa legs 134 further comprises a second leg 191 and an eighth pivot 248 The second leg 191 is a shaft that is further defined with a thirteenth end 233 and a fourteenth end 234. The fourteenth end 234 of the second leg 191 is attached to the twelfth strut 212 using the eighth pivot 248 such that the second leg 191 will rotate around the eighth pivot 248. In the first potential embodiment of the disclosure, the plurality of sofa legs 134 further comprises a left sofa leg 195 and a right sofa leg 196.

The first potential embodiment of this disclosure is made of wood and commercially available hardware. Methods to build the invention 100 described in this disclosure and to mount the invention 100 on a wall 261 are well known and documented in the carpentry arts. Other potential embodiments of this disclosure may include, but are not limited to plastics and metal including, but not limited to, polyvinyl chloride and aluminum.

The following definitions and directional references were used in this disclosure:

Pivot: As used in this disclosure, a pivot is a rod or shaft around which an object rotates or swings.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance.

Shaft: As used in this disclosure, the term shaft is used to describe a rigid cylinder that is often used as the handle of a tool or implement. The terms inner diameter of the shaft and outer diameter of the shaft are used as they would be used by those skilled in the plumbing arts. The definition of shaft explicitly includes solid shafts or shafts that are formed more like pipes with a hollow passage through the shaft that runs along the center axis of the shaft cylinder.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction.

Directional Reference: In this disclosure, the first strut 201 is considered to be the right side of the invention 100. The third strut 203 is considered to be the left side of the invention 100. When comparing a first object to a second object such that the first object is proximal to the first strut 201 then the first object is said to be the right object and the second object is said to be the left object.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An article of furniture comprising:

a wall frame, a bed frame, and a seat frame;

wherein the article of furniture is adapted to be mounted on a wall;

wherein the article of furniture is adapted for use as a bed;

wherein the article of furniture is adapted for use as a chair;

wherein the wall frame contains the bed frame and the seat frame;

wherein the bed frame attaches to the wall frame such that the bed frame is contained within the wall frame;

wherein the bed frame attaches to the wall frame such that the bed frame rotates out of the wall frame;

wherein the seat frame attaches to the bed frame such that the seat frame is accessible while the bed frame is stored within the wall frame;

wherein the seat frame attaches to the bed frame such that the seat frame rotates off of the bed frame such that the seat frame can be used as a chair;

wherein the wall frame is mounted on a wall;

wherein the wall frame comprises a first rectangular structure and a plurality of rails;

wherein the first rectangular structure is a rectangular frame that further comprises a first strut, a second strut, a third strut, and a fourth strut;

wherein each of the plurality of rails further comprises a plank and a track;

wherein each of the plurality of rails is a plank that is mounted on a strut selected from the first strut or the third strut;

wherein the plank is a rectangular plate;

wherein the track is a rectangular aperture that is formed through the plank.

2. The article of furniture according to claim 1
wherein the bed frame comprises a second rectangular structure, a plurality of bed slats, a plurality of locking arms, a plurality of sustaining arms, a plurality of carriages, a plurality of bed legs, and a plurality of seat supports;
wherein the plurality of bed slats are attached to the second rectangular structure;
wherein the plurality of bed legs are attached to the second rectangular structure;
wherein the plurality of locking arms attach the bed frame to the wall frame;
wherein the plurality of sustaining arms attach the bed frame to the wall frame;
wherein the plurality of carriages attach the bed frame to the wall frame;
wherein the plurality of seat supports attach the bed frame to the seat frame.

3. The article of furniture according to claim 2
wherein the second rectangular structure is a rectangular frame;
wherein the second rectangular structure further comprises a fifth strut, a sixth strut, a seventh strut, and an eighth strut;
wherein the plurality of bed slats form a first surface;
wherein the plurality of bed slats attach to the sixth strut and the eighth strut such that any first bed slat selected from the plurality of bed slats is parallel to any second bed slat selected from the plurality of bed slats.

4. The article of furniture according to claim 3
wherein each of the plurality of locking arms comprises locking bracket, a locking bolt, a notch and the first pivot;
wherein the notch is formed in the locking bracket;
wherein the locking bracket is further defined with a first end and a second end;
wherein the notch is sized such that the notch will fit around the locking bolt;
wherein the locking bolt is mounted to a strut selected from the group consisting of the fifth strut and the seventh strut;
wherein the locking bolt is mounted such that the locking bolt projects perpendicularly away from the selected strut;
wherein the second end of the locking bracket is mounted to the first strut if the fifth strut was selected;
wherein the second end of the locking bracket is mounted to the third strut if the seventh strut was selected;
wherein the locking bracket is mounted using the first pivot.

5. The article of furniture according to claim 4
wherein each of the plurality of sustaining arms comprises a first arm, a second arm, a locking mechanism, a second pivot, a third pivot, and a fourth pivot;
wherein the first arm is further defined with a third end and a fourth end;
wherein the second arm is further defined with a fifth end and a sixth end;
wherein the third end of the first arm and the sixth end of the second arm are connected with the third pivot;
wherein the fifth end of the second arm attaches to a strut selected from the group consisting of the fifth strut or the seventh strut using the second pivot;
wherein the fourth end of the first arm attaches to a strut selected from the group consisting of the first strut or the third strut;
wherein the third pivot further comprises the locking mechanism.

6. The article of furniture according to claim 5
wherein each of the plurality of carriages further comprises a hydraulic arm and a wheel;
wherein the hydraulic arm is further defined with a seventh end and an eighth end;
wherein the seventh end of the hydraulic arm attaches to a strut selected from the group consisting of the first strut or the third strut;
wherein the eighth end of the hydraulic arm attaches to a strut selected from the group consisting of the first strut or the third strut;
wherein the wheel attaches to a strut selected from the group consisting of the fifth strut or the seventh strut;
wherein the wheel attaches in such a manner that the wheel rotates freely around its axis;
wherein the wheel is mounted such that the wheel fits with the track of a rail selected from the plurality of rails.

7. The article of furniture according to claim 6
wherein each of the plurality of bed legs comprises a first leg;
wherein the first leg is further defined with a ninth end and a tenth end;
wherein the tenth end of the first leg attaches to the eighth strut using the fifth pivot in such a manner that the first leg can rotate around the fifth pivot.

8. The article of furniture according to claim 7
wherein the seat frame further comprises a third rectangular structure, a fourth rectangular structure, a plurality of sofa supports, and a plurality of sofa legs;
wherein the third rectangular structure is a rectangular frame that further comprises first plurality of seat slats;
wherein the first plurality of seat slats forms a second surface;
wherein the fourth rectangular structure is a rectangular frame that further comprises a second plurality of seat slats, the ninth strut, the tenth strut, the eleventh strut and the twelfth strut;
wherein the second plurality of seat slats forms a third surface;
wherein the second plurality of seat slats are attached to the tenth strut and the twelfth strut;
wherein the plurality of sofa supports attach the seat frame to the bed frame;
wherein the plurality of sofa legs are attached to the fourth rectangular frame.

9. The article of furniture according to claim 8
wherein the plurality of sofa supports further comprises a third arm, a sixth pivot and a seventh pivot;
wherein the third arm is a shaft that is further defined with an eleventh end and a twelfth end;
wherein the eleventh end of the third arm attaches to a strut selected from the group consisting of the ninth strut or the eleventh strut using the sixth pivot;
wherein the twelfth end of the third arm attaches to a strut selected from the group consisting of the fifth strut or the seventh strut using the seventh pivot.

10. The article of furniture according to claim 9
wherein each of the plurality of seat supports is a U shaped bar that attaches to a strut selected from the from the group consisting of the fifth strut or the seventh strut;
wherein each of the plurality of seat supports is a guide around which the third rectangular structure is hooked such that the third rectangular structure can slide along each of the plurality of seat supports.

11. The article of furniture according to claim 10
wherein the plurality of seat supports further comprises a left seat support and a right seat support;
wherein the left seat support mounts to the seventh strut;
wherein the right seat support mounts to the fifth strut.

12. The article of furniture according to claim 11
wherein each of the plurality of sofa legs further comprises a second leg and an eighth pivot;
wherein the second leg is further defined with a thirteenth end and a fourteenth end;
wherein the fourteenth end of the second leg attaches to the twelfth strut using the eighth pivot such that the second leg will rotate around the eighth pivot.

13. The article of furniture according to claim 12
wherein the plurality of rails further comprises a left rail and a right rail;
wherein the right rail is mounted on the first strut;
wherein the left rail is mounted on the third strut.

14. The article of furniture according to claim 13
wherein the plurality of locking arms further comprises a left locking arm and a right locking arm;
wherein the left locking arm mounts to the third strut and the seventh strut;
wherein the right locking arm mounts to the first strut and the fifth strut.

15. The article of furniture according to claim 14
wherein the plurality of sustaining arms further comprises a left sustaining arm and a right sustaining arm;
wherein the left sustaining arm attaches to the third strut and the seventh strut;
wherein the right sustaining arm attaches to the first strut and the fifth strut.

16. The article of furniture according to claim 15
wherein the plurality of carriages further comprises a left carriage and a right carriage;
wherein the left carriage mounts to the third strut and the seventh strut;
wherein the right carriage mounts to the first strut and the fifth strut.

17. The article of furniture according to claim 16 wherein the plurality of bed legs further comprises a left bed leg and a right bed leg.

18. The article of furniture according to claim 17
wherein the plurality of sofa supports further comprises a left sofa support and a right sofa support;
wherein the left sofa support mounts to the seventh strut and the eleventh strut;
wherein the right sofa support mounts to the fifth strut and the ninth strut.

19. The article of furniture according to claim 18
wherein the first potential embodiment of the disclosure, the plurality of sofa legs further comprises a left sofa leg and a right sofa leg.

* * * * *